US005946841A

United States Patent [19]

Roper

[11] Patent Number: 5,946,841

[45] **Date of Patent: *Sep. 7, 1999**

[54] LOCKING DEVICE

[76] Inventor: Richard Blair Roper, 717 White Oak Cir., Flowood, Miss. 39208

[ * ] Notice: This patent is subject to a terminal disclaimer.

[21] Appl. No.: 09/074,711

[22] Filed: May 8, 1998

Related U.S. Application Data

[63] Continuation-in-part of application No. 08/810,643, Mar. 3, 1997, Pat. No. 5,784,819.

[51] Int. Cl.[6] ..... F41A 17/00

[52] U.S. Cl. ..... 42/70.11; 42/70.06; 42/70.07

[58] Field of Search ..... 42/70.11, 70.06, 42/70.07

[56] References Cited

U.S. PATENT DOCUMENTS

| | | | |
|---|---|---|---|
| 667,051 | 1/1901 | Ackerman . | |
| 1,830,213 | 11/1931 | Stiennon | 42/42.01 |
| 2,487,971 | 11/1949 | Jenkinson | 42/70 |
| 4,084,341 | 4/1978 | Cervantes | 42/1 Y |
| 4,302,898 | 12/1981 | Larve | 42/1 LP |
| 4,398,366 | 8/1983 | Wernicki | 42/1 LP |
| 4,499,681 | 2/1985 | Bako et al. | 42/1 Y |
| 5,090,148 | 2/1992 | Brooks | 42/70.11 |
| 5,400,538 | 3/1995 | Shannon | 42/70.07 |

*Primary Examiner*—Charles T. Jordan
*Assistant Examiner*—Meena Chelliah

[57] ABSTRACT

An equipment locking device is disclosed which provides ease in operation by authorized users by utilizing a sequence of locking rods for combinational locking of various trigger activated equipment, including firearms, without the need for attachment of external accessories. Indentations in the locking rods must be aligned to form a keyway which permits movement of an activation rod, which forms part of or is connected to the trigger mechanism.

14 Claims, 3 Drawing Sheets

LOCKING DEVICE

This application is a cip of application Ser. No. 08/810,643 filed Mar. 3, 1997, now U.S. pat. No. 5,784,819.

BACKGROUND OF THE INVENTION

A number of locking mechanisms have been devised to prevent the unauthorized use of trigger-activated equipment. These concerns arise relating to use of such equipment by unauthorized persons, including children and persons who tamper with such equipment. With regard to firearms, danger may arise when persons with illicit purposes take without right weapons from police officers or private persons. While some equipment, particularly firearms, typically have a safety device, such devices are deficient as impediments to prevent such unauthorized uses. Locks have been created which attach to the trigger of equipment to prevent access to the trigger, and thus render the equipment inoperable. Representative patents dealing with firearm triggers include BROOKS, U.S. Pat. No. 5,090,148; BAKO, U.S. Pat. No. 4,499,681; and CERVANTES, U.S. Pat. No. 4,084,341. Such locks are cumbersome and difficult to remove or to readily operate so as to permit use by authorized users. This problem can reduce the effectiveness in emergency situations. For example, the police officer in immediate need of a firearm, or the private citizen who must use a firearm for self-defense, could suffer if significant delays were involved in making the firearm operational. While the firearm safety device in BROOKS attempted to alleviate such cumbersomeness by integrating the lock into the firearm system, the disclosed lock involves a complicated multi-wheel system which requires being able to visually see the dials utilized upon the firearm safety mechanism in order to make the weapon operational. Such safety mechanisms also involve numerous mechanical elements, the complexity of which leads to maintenance or operational problems. It would be desirous to provide a safety mechanism which can lock equipment, prevent unauthorized use of equipment, such as a firearm or tool, yet be readily activated by an authorized user. It would also be desirable if the locking mechanism would require no external accessories, such that the authorized user could readily activate, or deactivate, the device at any time. It would also be desirable to provide a safety lock which can be activated or deactivated without viewing the lock. It would also be desirable to provide a safety lock which is not bulky, and which would not hamper operation of the equipment when installed.

SUMMARY OF THE INVENTION

It is an object of the present invention to provide a locking device which will render the equipment inoperable to unauthorized users.

It is another object of the present invention to provide a locking device which can be quickly activated or deactivated by authorized users.

It is an still another object of the present invention to provide a locking device which does not require external accessories.

It is an object of the present invention to provide a locking device which can be activated or deactivated without viewing the mechanism.

It is an object of the present invention to provide a locking device which is easily incorporated into existing devices.

It is an object of the present invention to provide a locking device which is easily manipulated to lock and unlock.

These and other objects are provided by a locking device which utilizes a set of locking rods, which when all are in certain positions, provide a keyway for passage of an activation rod which must move in order for the equipment to be operated. If one or more of the locking rods is not in the operating position, the activation rod cannot move, preventing the operation of the equipment.

DESCRIPTION OF THE DRAWINGS

There are shown in the following described drawings embodiments of the present invention.

DESCRIPTION OF EMBODIMENTS

One embodiment of the present invention is a firearm locking device for a weapon having a trigger, which lock comprises an activation rod which can be operatively locked to prevent movement of the trigger or firing mechanism, and two or more locking rods operatively optionally moveable to a locked configuration which prevents movement of the activation rod or to an unlocked configuration which permits movement of the activation rod. The activation rod is either monolithically connected to or operatively linked to the trigger or firing mechanism such that the activation rod must move for the trigger or firing mechanism to operate. The locking rods are preferably set in the firearm in a location which is forward of the trigger. In other words, the lock members are set in the device on the opposite side of the trigger from the handle, if any, of the device, or the portion of the device which is grasped or otherwise held for operation.

The locking rods are preferably sliding members that can be set to provide one or more combinations of "on" and "off" settings. These locking rods are of any shape functional, but are preferably cylindrical which contain indentations perpendicular to the long axis of the locking rods. The indentations are configured such that they will align so as to provide a keyway which permits the activation rod to move when force is applied to move the trigger. By movement of the locking rods, the keyway configuration is altered into one in which the activation rod is no longer moveable.

Figure 1:
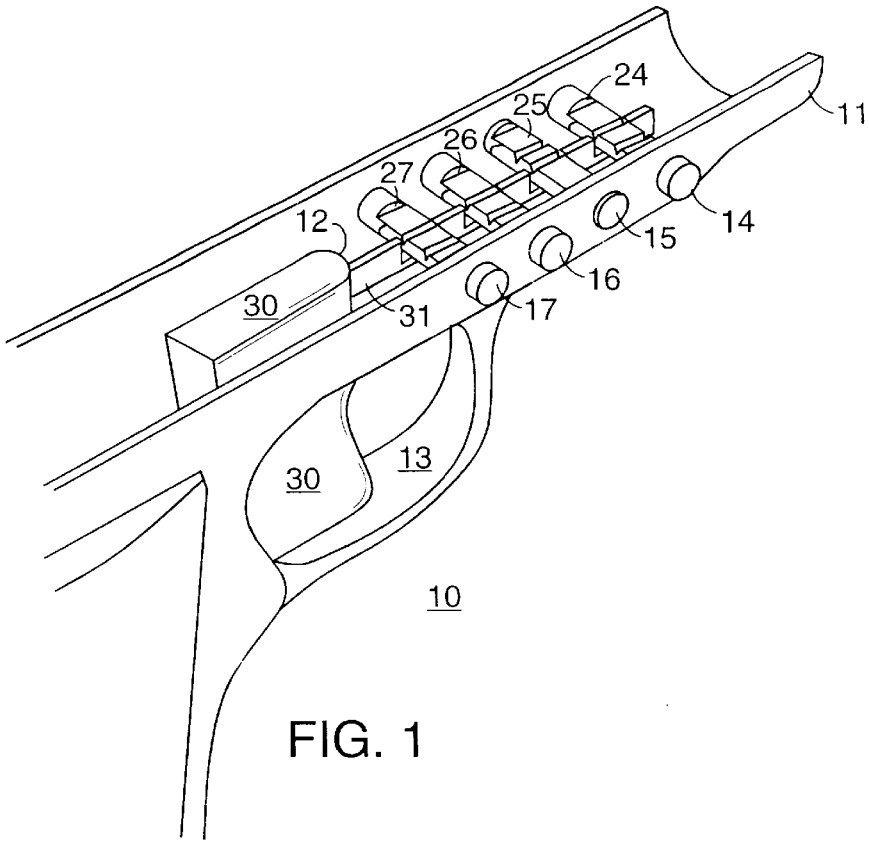
FIG. 1 depicts a housing showing locking rods and activation rod of the present invention.

Referring now the figures, FIG. 1 depicts the trigger area of trigger-operated equipment 10 having housing 11, trigger 12, trigger guard 13, a plurality of housing openings 14, 15, 16, and 17, and a plurality of sliding locking rods, 24, 25, 26, and 27. Also shown in FIG. 1 is activator rod 31, as is more fully described below.

Figure 2:
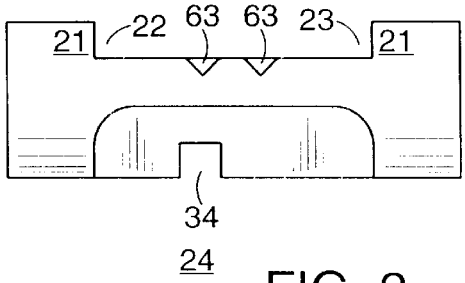
FIG. 2 depicts a sliding locking rod of the present invention.
Figure 3:
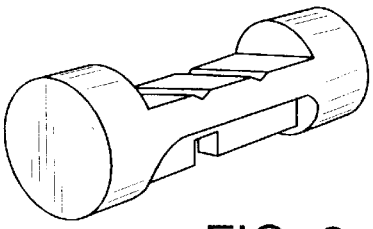
FIG. 3 depicts a perspective view of a sliding locking rod of the present invention.
Figure 4:
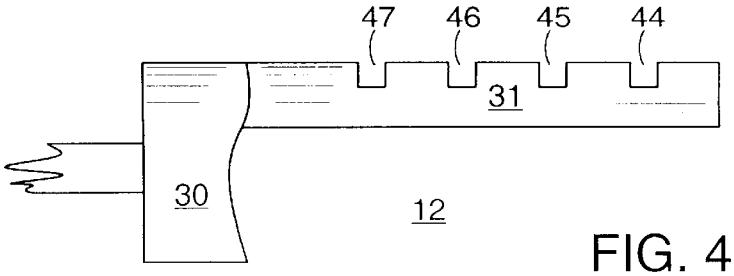
FIG. 4 depicts an activation rod of the present invention.

FIG. 2 depicts a side-view of a sliding locking rod 24, which is located within housing opening 14. Each housing opening 14 through 17 has a corresponding sliding locking rod 24 through 27, respectively. The additional locking rods 25 through 27 are not depicted in FIG. 2 to facilitate the viewer's image. Sliding locking rod 24 has raised stop ends 21 and keyway indentation 34. Stop ends 21 have a purpose of stopping the longitudinal translation of sliding locking rod 24 by abutment of interior side 22 or 23 against an obstruction, thus maintaining at least a portion of sliding locking rod 24 within housing 11 and housing opening 14. Each locking rod 24 through 27 has a corresponding equivalent interior side 22 or 23. Indentation 34 may be offset from center; but the exact location is dependent upon the lock sequence strategy established for the particular device. Sliding locking rod 24 can be manipulated, such as by the push from a finger, to translate within housing opening 14 to one or more positions. FIG. 4 is a side-view of the trigger unit 12 having trigger body 30, activator rod 31 and a plurality of indentations 44, 45, 46, and 47. Trigger body 30 and activator rod 31 may be adjoined by monolithic construction means as in this depiction, but in other embodiments a trigger body and an activator rod could be separate elements joined by known joining means, such as by welding, bolting, or through a pin or pivoting connection. Regardless of the embodiment, movement of the trigger 12 sufficient to initiate the operation of the equipment requires movement of activator rod 31. In still other embodiments using a double action trigger system, an activator rod 31 could be joined to a moveable element of the trigger system such that freezing or fixing of the activator rod would prevent use of the trigger to engage or operate the firing action of the particular weapon. For example, in a Smith & Wesson Model 59 Double Action pistol, an activator rod would join the trigger at a point above or below the trigger insert pin so that an immovable activator rod would prevent trigger rotation about the trigger insert pin.

Figure 5:
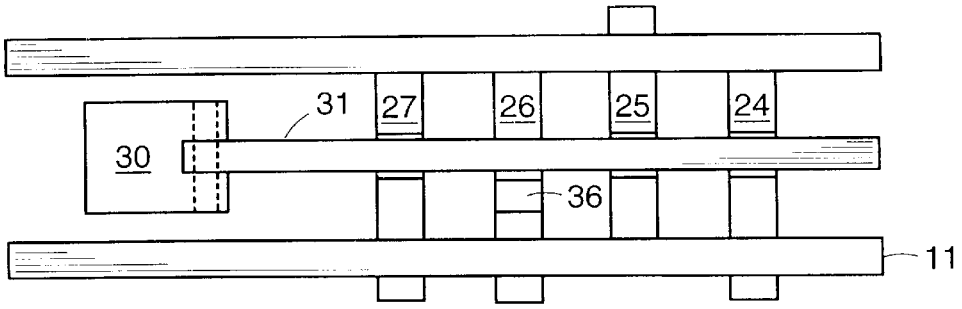
FIGS. 5 and 6 depict cross-sectional views of the housing of FIG. 1 with sliding locking rods of FIG. 2 type and an activation rod of FIG. 4 type.

FIG. 5 depicts a cross-sectional bottom-view of housing 11 and having therein trigger body 30 and activator rod 31 together with sliding locking rods 24, 25, 26, and 27. Indentation 36 of sliding locking rod 26 is exposed, indicative of sliding locking rod 26 being in a position transecting activator rod 31 through activator rod indentation 46 to obstruct movement of activator rod 31.

Figure 6:
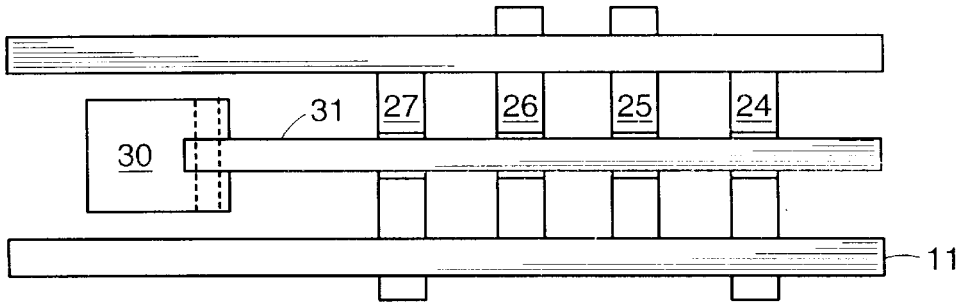

FIG. 6 is a second cross-sectional bottom-view of housing 11 previously shown in FIG. 5. However, in FIG. 6, sliding locking rod 26 has been moved such that indentation 36 of sliding locking rod 26 previously shown in FIG. 5 is now in alignment with activator rod 31 thereby permitting the movement of activator rod 31 through the keyway formed by alignment of indentations 34, 35, 36 and 37. Although four sliding locking rods are shown in this embodiment, there may be fewer, or as many as may be practicable for the equipment with which the invention is to be used. It must be noted that the greater the number of locking rods, the greater the number of possible combinations, only one of which will work to cause alignment of the locking rod indentations. Accordingly, the greater the number of locking rods, the more difficult it will be for an unauthorized user to initiate the operation of the equipment through trial and error.

Figure 7:
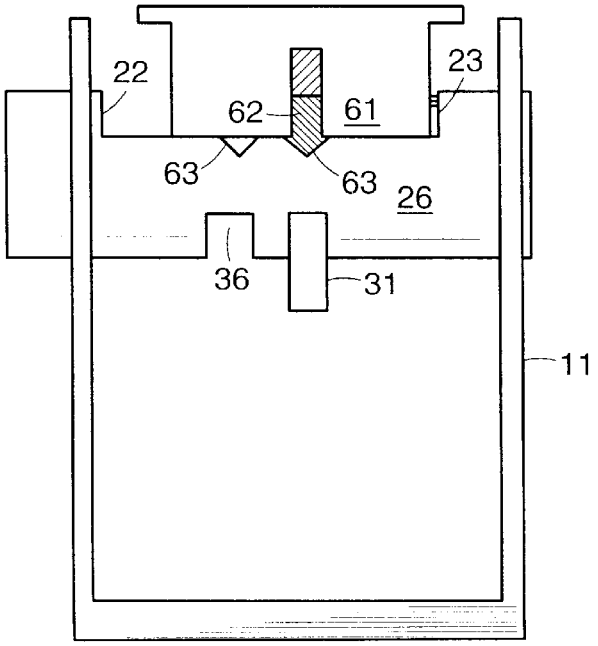
FIG. 7 is an end view of the housing with locking rod, activation rod and retainer bar.
Figure 8:
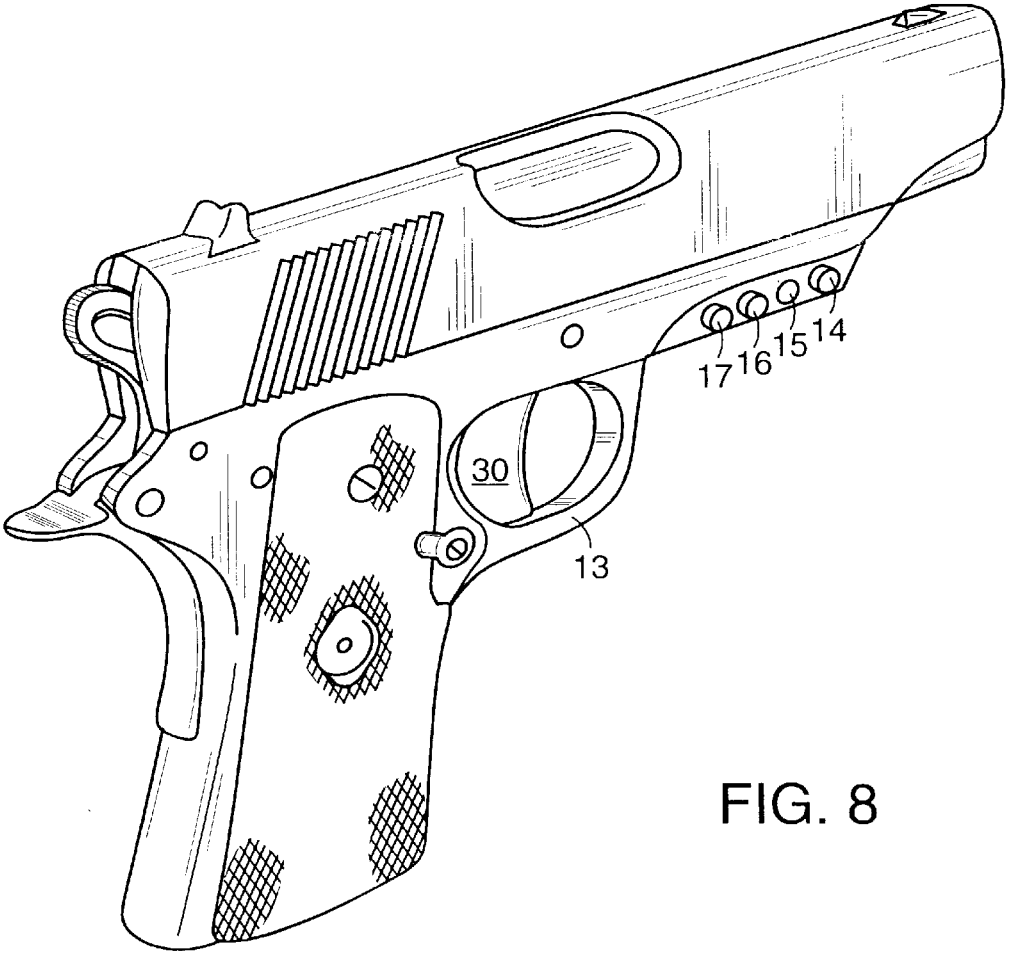
FIG. 8 depicts a firearm incorporating the present invention.

FIG. 7 depicts a cross-sectional end view of the housing 11 containing therein sliding locking rod 26 and showing interior sides 22 and 23, and retaining bar 61 which acts to prevent the total translation of sliding locking rod 26 out of the housing 11. The position of sliding locking rod 26 is the same as that which was depicted in FIG. 5 such that activator rod 31 is not aligned in indentation 36. Retaining bar 61 preferably not only prevents the safety locking rods from sliding out of the housing 11, but also prevents the safety locking rods from rotating with in the housing openings. Prevention of rotation of the locking rods can also be accomplished by using non-cylindrical locking rods. Retaining bar 61 also preferably has a projection 62 on the side facing the safety locking rods that engages in one or more shallow depressions 63 in the safety locking rods to retain the safety locking rod in the preferred position. If desired, spring-loaded mechanisms can be employed to bias the projection 62 more securely in the shallow depressions 63.

Removal of retaining bar 61 allows for the removal and reversal of the sliding locking rods, altering the setting of the locking rods required to form the keyway to allow movement of the activation rod and operation of the equipment. The retaining bar 61 is generally mounted inside the housing 61, and removal of the retaining bar accomplished only by disassembly of the housing. This prevents an unauthorized user from easily removing the retaining bar 61 and viewing the required alignment of the locking rod indentations. Alternatively, the retaining bar 61 may be mounted on the outside of the housing 11, or form a part of the housing 11, provided that removal of the retaining bar is rendered difficult by the means of attachment, such as fasteners that can only be removed with a special screwdriver or the like.

While the above description of the present invention primarily illustrates use in a firearm, such a trigger safety device can be used in other equipment as well.

The foregoing description is not intended as a limitation on the scope of the invention and variations may be made within the spirit thereof.

What I claim is:

1. A device for optionally preventing the operation of firearms, comprising;

a housing containing a plurality of openings;

a plurality of locking rods, each of said plurality of locking rods extending through one of said openings in said housing and being longer than the width of said housing, the axes of said plurality of locking rods lying in parallel planes, with each of said plurality of locking rods containing an indentation;

an activation rod connected to the trigger or an element of the firing mechanism of said firearm, said activation rod extending into said housing, movement of said activation rod being required for the initiation of operation of said trigger or element of the firing mechanism connected to said activation rod, the axis of said activation rod lying in a plane perpendicular to the axes of said plurality of locking rods, said activation rod containing a plurality of indentations, whereby one of said plurality of locking rod indentations corresponds to each of said plurality of locking rods;

said plurality of locking rod indentations sized so as to allow sliding passage of said activation rod;

said plurality of activation rod indentations sized so as to allow sliding passage of said plurality of locking rods;

said plurality of locking rod indentations being located on said plurality of locking rods whereby said plurality of locking rod indentations can be aligned by moving said plurality of locking rods within said openings in said housing to form a keyway allowing movement of said activation rod, or one or more of said plurality of locking rod indentations can be misaligned to prevent movement of said activation rod, whereby the operation of said trigger or element of the firing mechanism connected to said activation rod may be commenced or may be prevented at the option of the operator by movement of said plurality of locking rods.

2. A device for optionally preventing the operation of equipment as in claim 1 wherein said plurality of locking rods are of a length sufficient to extend completely through said housing plus sufficient excess length extending outside of said housing whereby said plurality of locking rods may be moved along their axes by applying pressure to said excess length of said plurality of locking rods extending outside of said housing.

3. A device for optionally preventing the operation of equipment as in claim 1, further comprising means to limit the range of sliding movement of said plurality of locking rods extending through said housing openings, whereby said plurality of locking rods must remain within said housing openings.

4. A device for optionally preventing the operation of equipment as in claim 3, wherein said means to limit the range of sliding movement comprises;

raised ends on each of said plurality of locking rods;

a retaining bar fixed within said housing whereby one of said raised ends on each of said plurality of locking rods contacts said retaining bar at the intended limit of movement of said locking rod in one direction, preventing further movement of said plurality of locking rods in that direction, and the other said raised end on each of said plurality of locking rods contacts said retaining bar at the intended limit of movement of said locking rod in the opposite direction, whereby the range of movement of said plurality of locking rods is fixed.

5. A device for optionally preventing the operation of equipment as in claim 3, wherein said means to limit the range of sliding movement comprises;

raised ends on each of said plurality of locking rods;

a retaining bar removably mounted externally on said housing and extending into said housing whereby one of said raised ends on each of said plurality of locking rods contacts said retaining bar at the intended limit of movement of said locking rod in one direction, preventing further movement of said plurality of locking rods in that direction, and the other said raised end on each of said plurality of locking rods contacts said retaining bar at the intended limit of movement of said locking rod in the opposite direction, whereby the range of movement of said plurality of locking rods is fixed.

6. A device for optionally preventing the operation of equipment as in claim 1 wherein said housing forms an integral part of the equipment the operation of which is to be prevented.

7. A device for optionally preventing the operation of equipment as in claim 1 wherein the equipment is a firearm.

8. A device for optionally preventing the operation of equipment as in claim 1 wherein the equipment is a trigger activated tool.

9. A device for optionally preventing the operation of equipment as in claim 1, further comprising means to establish at least two set positions for each of said plurality of locking rods.

10. A device for optionally preventing the operation of equipment as in claim 9, wherein said means to establish at least two set positions further comprises;

at least one notch in each of said plurality of locking rods;

a projection within said housing sized to interact with said at least one notch, whereby the position of each of said plurality of locking rods can be set by aligning said at least one notch with said projection.

11. A device for optionally preventing the operation of equipment as in claim 10, wherein said projection is located on said retaining bar.

12. A device for optionally preventing the operation of equipment as in claim 10, wherein said projection is spring biased to facilitate movement of said projection into and out of said at least one notch.

13. A device for optionally preventing the operation of equipment as in claim 1, wherein one or more of said plurality of locking rods may be removed from said housing and replaced in reverse position, whereby the position of said plurality of locking rods required for alignment of said locking rod indentations is altered.

14. A device for optionally preventing the operation of firearms, comprising;

a housing containing a plurality of openings, said housing forming an integral part of the firearm;

a plurality of locking rods, each of said plurality of locking rods extending through one of said openings in said housing and being longer than the width of said housing, the axes of said plurality of locking rods lying in parallel planes, with each of said plurality of locking rods containing an indentation;

an activation rod connected to the trigger or an element of the firing mechanism of said firearm, said activation rod extending into said housing, movement of said activation rod being required for the initiation of operation of said trigger or element of the firing mechanism connected to said activation rod, the axis of said activation rod lying in a plane perpendicular to the axes of said plurality of locking rods, said activation rod containing a plurality of indentations, whereby one of said plurality of activation rod indentations corresponds to each of said plurality of locking rods;

said plurality of locking rod indentations sized so as to allow sliding passage of said activation rod;

said plurality of activation rod indentations sized so as to allow sliding passage of said plurality of locking rods;

raised ends on each of said plurality of locking rods;

a retaining bar fixed within said housing whereby one of said raised ends on each of said plurality of locking rods contacts said retaining bar at the intended limit of movement of said locking rod in one direction, preventing further movement of said plurality of locking rods in that direction, and the other said raised end on each of said plurality of locking rods contacts said retaining bar at the intended limit of movement of said locking rod in the opposite direction, whereby the range of movement of said plurality of locking rods is fixed;

at least one notch in each of said plurality of locking rods;

a projection within said housing sized to interact with said at least one notch, whereby the position of each of said plurality of locking rods can be set by aligning said at least one notch with said projection;

said plurality of locking rod indentations being located on said plurality of locking rods whereby said plurality of locking rod indentations can be aligned by moving said plurality of locking rods within said openings in said housing to form a keyway allowing movement of said activation rod, or one or more of said plurality of locking rod indentations can be misaligned to prevent movement of said activation rod, whereby the operation of said trigger or element of the firing mechanism connected to said activation rod may be commenced or may be prevented at the option of the operator by movement of said plurality of locking rods.

* * * * *